US009803418B2

(12) United States Patent
Dintheer

(10) Patent No.: US 9,803,418 B2
(45) Date of Patent: Oct. 31, 2017

(54) DROP-DOWN SEAL AND BUILDING PART

(71) Applicant: PLANET GDZ AG, Tagelswangen (CH)

(72) Inventor: Andreas Dintheer, Illnau (CH)

(73) Assignee: PLANET GDZ AG, Tagelswangen (CH)

( * ) Notice: Subject to any disclaimer, the term of this patent is extended or adjusted under 35 U.S.C. 154(b) by 0 days.

(21) Appl. No.: 14/418,152

(22) PCT Filed: Jul. 26, 2013

(86) PCT No.: PCT/EP2013/065814
§ 371 (c)(1),
(2) Date: Jan. 29, 2015

(87) PCT Pub. No.: WO2014/019955
PCT Pub. Date: Feb. 6, 2014

(65) Prior Publication Data

US 2015/0211288 A1 Jul. 30, 2015

(30) Foreign Application Priority Data

Jul. 30, 2012 (EP) ..... 12178448

(51) Int. Cl.

| | |
|---|---|
| ***E06B 7/215*** | (2006.01) |
| ***E06B 7/20*** | (2006.01) |
| ***E06B 7/205*** | (2006.01) |
| ***E06B 7/28*** | (2006.01) |

(52) U.S. Cl.
CPC ..... *E06B 7/215* (2013.01); *E06B 7/20* (2013.01); *E06B 7/205* (2013.01); *E06B 7/28* (2013.01)

(58) Field of Classification Search
CPC ... E06B 7/215; E06B 7/28; E06B 7/20; E06B 7/205
See application file for complete search history.

(56) References Cited

FOREIGN PATENT DOCUMENTS

| | | | | |
|---|---|---|---|---|
| AU | 2007237192 | A1 | 6/2008 | |
| CH | 688741 | A5 | 2/1998 | |
| CH | EP 2085559 | A3 * | 9/2014 | ..... E06B 7/215 |
| CN | 2263188 | Y | 9/1997 | |
| DE | 2657279 | A1 | 6/1978 | |

(Continued)

OTHER PUBLICATIONS

Machine translation of DE 29720978.*
Machine translation of FR 2712346.*

*Primary Examiner* — Katherine Mitchell
*Assistant Examiner* — Marcus Menezes
(74) *Attorney, Agent, or Firm* — Browdy and Neimark, PLLC

(57) ABSTRACT

The invention relates to a drop-down seal for a building part comprising a housing (1), a sealing strip (2, 3) that can be raised and lowered in said housing (1), and a spring-loaded lowering mechanism (8), which causes automatic lowering of the sealing strip (2, 3) when the building part is closed. The lowering mechanism (8) is connected to a slide (4, 6), which protrudes beyond the housing (1) at one end and which activates the lowering mechanism (8) when the building part is closed. The slide (4, 5) applies a tension to the lowering mechanism (8). The drop-down seal according to the invention enables a one-sided triggering in tension, wherein the seal has a space-saving design.

12 Claims, 5 Drawing Sheets

(56) References Cited

FOREIGN PATENT DOCUMENTS

| | | | | | |
|---|---|---|---|---|---|
| DE | 29720978 | U1 * | 3/1998 | ..... | E05C 17/44 |
| DE | 29916090 | U1 | 2/2001 | | |
| DE | 202011001104 | U1 | 4/2012 | | |
| DE | 202012100752 | U1 * | 6/2013 | ..... | E06B 7/215 |
| EP | 0037131 | A2 | 10/1981 | | |
| EP | 0338974 | A2 | 10/1989 | | |
| EP | 0509961 | A1 | 10/1992 | | |
| EP | 2085559 | A2 | 8/2009 | | |
| FR | 2416333 | A1 | 8/1979 | | |
| FR | 2712346 | A1 * | 5/1995 | ..... | E06B 7/20 |
| WO | 2009155295 | A1 | 12/2009 | | |
| WO | WO 2009155295 | A1 * | 12/2009 | ..... | E05D 15/06 |

* cited by examiner 1
2
3
4
5
6
7
8
80
81
82

DROP-DOWN SEAL AND BUILDING PART

TECHNICAL FIELD

The present invention relates to a drop-down seal and to a building part.

PRIOR ART

Drop-down seals for doors are well known. They prevent light transmissions, provide soundproofing and, depending on the embodiment, they can also suppress air circulation. Lowerable door seals customarily essentially consist of a housing in the form of a downwardly open, U-shaped profile rail, a sealing strip which is held in said housing and is displaceable relative thereto and has a sealing element, and a drive mechanism for lowering and for raising the sealing strip. The sealing strip is customarily lowered automatically during the closing of the door by a compressive force acting in the longitudinal direction on an actuating bar or slide and setting the mechanical lowering mechanism into operation. Door seals of this type are known, for example, from EP 0 338 974, DE 299 16 090 and EP 0 509 961.

Tried and tested lowering mechanisms which are triggered on one side are described, for example, in EP 0 509 961 and CH 688 741. Said lowering mechanisms use one or more leafsprings arranged one behind another. Each leafspring is fastened at a first end, which is adjacent to that end of the slide which protrudes beyond the housing, to the slide itself. Each leafspring is furthermore fastened at its central region to the sealing strip and at its end remote from the protruding end of the slide to the housing. As a result, the pressure acting on the slide during closing of the door is transmitted to the leafsprings, the latter bend and lower the sealing strip.

EP 0 037 131 and DE 20 2011 001 104 U also trigger the lowering mechanism via a compressive force.

AU 2007 237 192 describes a drop-down seal which is triggered via compressive force. This compressive force is changed via a lever mechanism into a tensile force which likewise acts on the lowering mechanism.

DE 297 20 978 U and DE 26 57 279 disclose drop-down seals which are triggered via compressive force and which can be actuated via a tensile force even when the door is open.

However, no practicable sealing solutions are known for multi-part sliding doors, sliding windows and partition walls.

SUMMARY OF THE INVENTION

It is therefore an object of the invention to provide a drop-down seal which is also usable for multi-part sliding doors, multi-part sliding windows and partition walls.

It is a further object of the invention to provide a building part, in particular a multi-part sliding door, a multi-part sliding window and a partition wall, which has a drop-down seal.

The drop-down seal according to the invention for a building part has a housing, a sealing strip which is raisable and lowerable in said housing, and a spring-loaded lowering mechanism. The lowering mechanism brings about automatic lowering of the sealing strip during closing of the building part. Said lowering mechanism is connected to a slide which protrudes at one end beyond the housing, preferably in the longitudinal direction of the housing. The slide activates the lowering mechanism during closing of the building part. The slide applies a tension to the lowering mechanism. The lowering mechanism is activated with a tensile force by the slide.

In order to actuate the slide, there is preferably an arm which protrudes laterally beyond the housing and which runs at least approximately perpendicularly to the longitudinal direction of the sealing strip. Said arm is operatively connected to the slide, or is connected to the latter or is arranged thereon.

This mechanical drop-down seal can be used in particular in single-part and multi-part displaceable building parts. Since said drop-down seal is triggered by tension and not by compression, entirely different building solutions can be realized than with the known automatic, mechanical drop-down seals.

Despite being triggered by tension, the seal advantageously does not have to be designed to be higher or wider than the known seals triggered by compression. In particular, said seal does not have to be designed to be larger than the seals described in CH 688 741 or EP 0 338 974.

The lowering mechanism preferably equates to the known mechanisms. It is spring-loaded, and therefore it automatically raises the seal again when an external force is removed. It preferably has a triangular arrangement with levers and/or bending springs, which triangular arrangement, by means of a corresponding arrangement, permits the relative movement of the sealing strip with respect to the housing. In a preferred embodiment, the lowering mechanism is connected at a first fastening point to the slide, is connected at a second fastening point to the sealing strip and is fastened at a third fastening point to the housing. In a preferred embodiment, the third fastening point is arranged closer to the protruding end of the slide then the first fastening point.

In a preferred embodiment, the lowering mechanism has at least one spring, in particular a leafspring. Use can also be made of, for example, spiral springs, depending on the type of lowering mechanism. The spring, in particular the leaf spring, is fastened to at least one of the abovementioned fastening points. If the spring is of single-piece design, a first of its ends is fastened to or arranged on the first fastening point, its middle region is fastened to or arranged on the second fastening point and its second end is fastened to or arranged on the third fastening point. The spring, in particular the leafspring, can also be of multi-piece design, for example can consist of two parts, wherein one end in each case of the two parts is fastened to the second, middle fastening point.

The slide preferably has a force transmission rod which extends in the housing in the longitudinal direction thereof. The actuating rod preferably extends approximately over the entire length of the sealing strip. It preferably extends to the same extent as the springs, in particular the leafsprings, expand in the longitudinal direction of the housing. The slide preferably furthermore comprises an actuating rod which protrudes beyond the housing and is fixedly connected to the force transmission rod.

The at least one spring, in particular the leafspring, is preferably fastened at its first fastening point to the force transmission rod. The force transmission rod is preferably a flat rod, and therefore it requires a relatively small amount of space within the seal and the seal has a relatively low overall height.

The at least one spring, in particular the leafspring, is preferably held at its third fastening point so as to be pivotable relative to the housing. This permits the sealing strip to be lowered in a manner running approximately perpendicularly to the longitudinal direction of the sealing strip.

In order to transmit an external tensile force to the slide, in a preferred embodiment the arm is arranged on the slide or on the actuating rod of the slide, wherein the arm protrudes beyond the housing, and wherein the arm runs at least approximately perpendicularly to the longitudinal direction of the sealing strip. Said arm preferably also runs at least approximately perpendicularly to the lowering direction of the sealing strip. The arm is preferably fastened releasably to the slide. Said arm preferably forms a stop surface for bearing against a positionally fixed or movable neighboring component of the building part.

Owing to the use of an arm protruding in the manner of a flag, the tried and tested lowering mechanism according to CH 688 741 can be used, but the slide is now pulled and not pushed. For this purpose, only the arrangement of the springs, in particular of the leafsprings with respect to the protruding part of the slide, has to be changed; or the slide protrudes in the seal according to the invention at the other end of the housing than in CH 688 741. A known seal can therefore be used without all too great structural modifications for a multiplicity of new building parts, in particular in multi-part sliding systems. However, the invention is not restricted to this modification of the known drop-down seal but rather also extends to other modified, known lowering mechanisms or novel lowering mechanisms which are activatable by tension.

The building part according to the invention has such a drop-down seal according to the invention, wherein the building part has at least one movable panel which closes a building opening and in or on which the drop-down seal is arranged. According to the invention, the building part has a component which is adjacent to the movable panel and brings about the tension of the slide on the lowering mechanism.

The adjacent component preferably has a stop surface for the arm, said stop surface running at least approximately perpendicularly to the longitudinal direction of the sealing strip.

At least one of the components is preferably a second movable panel.

The tension on the slide can take place at an end of the slide which is on the rear side in the closing direction of the door. Alternatively, in another embodiment, the tension can take place at that end of the slide which is at the front in the closing direction of the door.

In preferred embodiments, the building part is a single-part sliding door, a multi-part sliding door system, a single-part sliding window, a multi-part sliding window system or a single-part or multi-part partition wall.

Further embodiments are indicated in the dependent claims.

BRIEF DESCRIPTION OF THE DRAWINGS

A preferred embodiment of the invention is described below with reference to the drawings which serve merely for explanation and should not be interpreted as being limiting. In the drawings.

DESCRIPTION OF PREFERRED EMBODIMENTS

Figure 1:
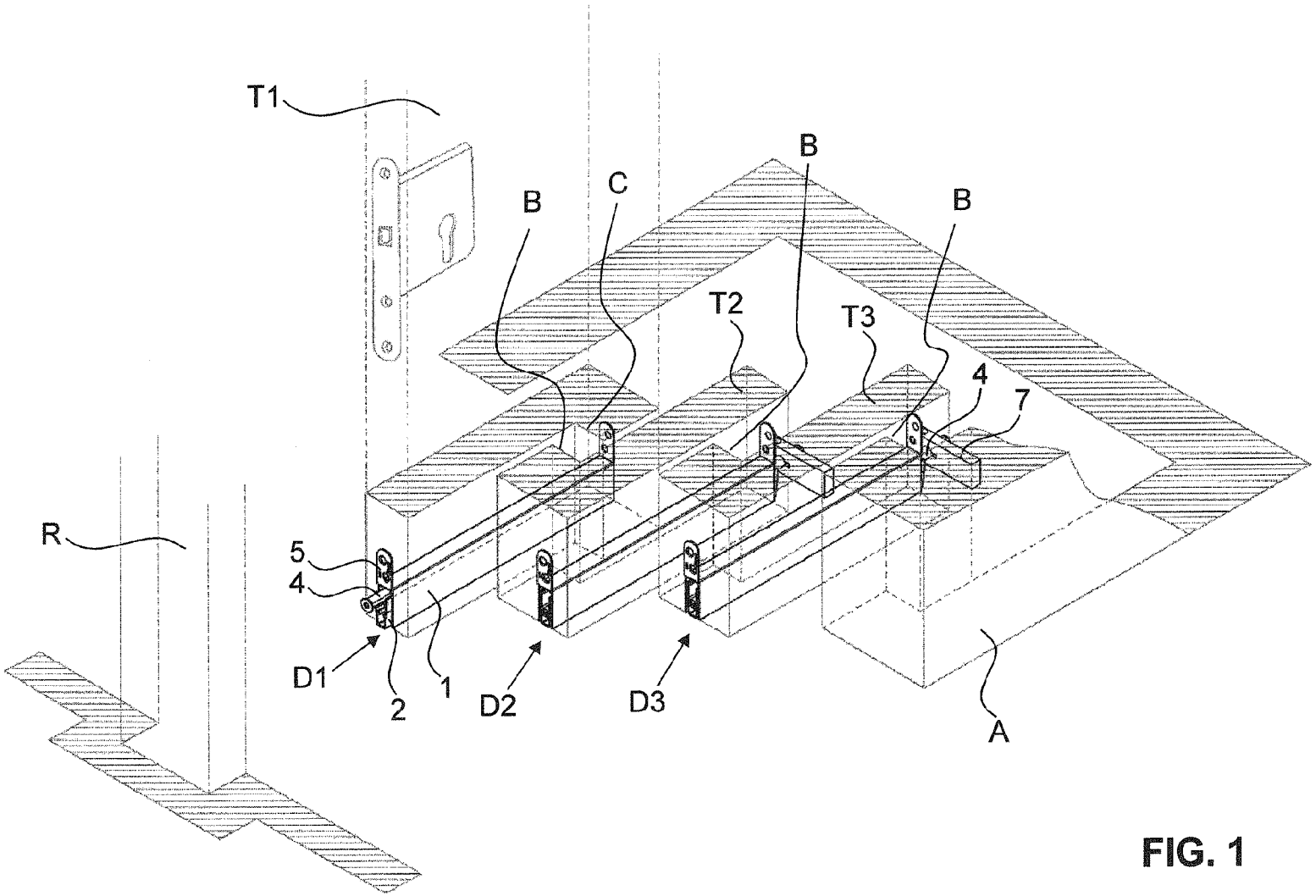
FIG. 1 shows a schematic illustration of a multi-part sliding door or partition wall or sliding door, in the partially open state with raised seals.
Figure 2:
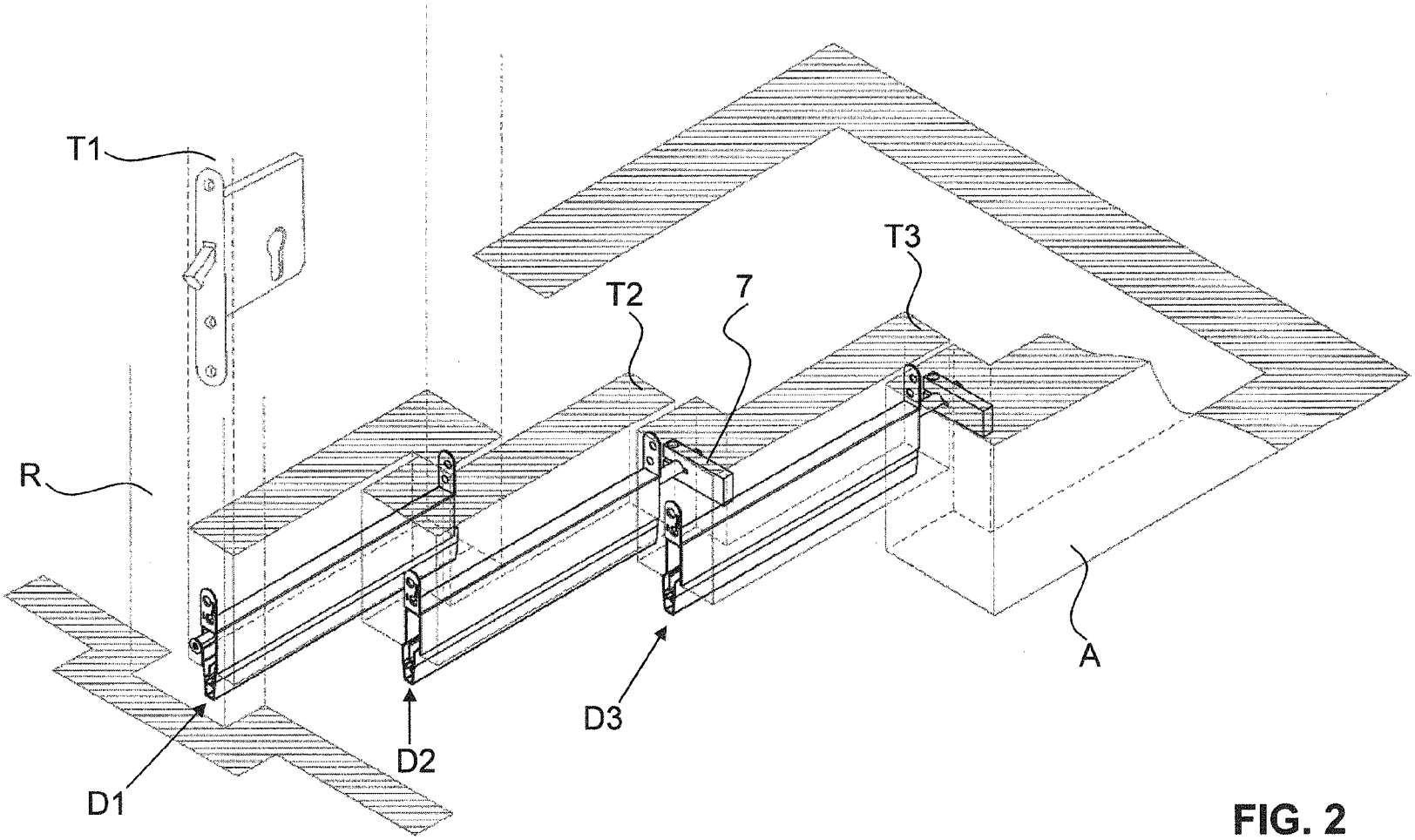
FIG. 2 shows the sliding door or partition wall according to FIG. 1 in the closed state with lowered seals.

FIGS. 1 and 2 illustrate a drop-down seal according to the invention in a preferred application. However, it is not restricted to this type of application.

FIGS. 1 and 2 show a building part in the form of a multi-part partition wall or a multi-part sliding door. Relevant guide rails embedded in the floor or in the ceiling are not illustrated. The partition wall or the sliding door system has a plurality of panels T1, T2, T3 which are arranged next to one another and are displaceable relative to one another. Sliding mechanisms of this type are well known. In the figures, a three-part panel system is illustrated. However, the seal according to the invention can also use systems with one, two, four or more panels.

The building part furthermore has at least one front frame R and a rear frame A, between which the panels T1, T2, T3 are held. The rear frame is preferably part of a pocket or station, into which the panels are retracted when not in use. This pocket can likewise be seen in the figures. The first panel T1, which is frontmost in the open state, preferably has a locking mechanism and can therefore be fixed to the front frame R. The locking mechanism is preferably a door lock.

A drop-down seal D1, D2, D3 is arranged in each panel T1, T2, T3. Said drop-down seals are preferably let into corresponding grooves of the panels. However, they can be fastened to an end side or can be arranged laterally on the panels. In this example, the seals D1, D2, D3 are fastened on at least one end side, preferably to both end sides of the panel T1, in each case by means of angle brackets 5.

An actuating bar or actuating button 4 protrudes beyond the drop-down seals D1, D2, D3 at one end in each case. In this example, the frontmost first drop-down seal D1 of the first panel T1 has an actuating bar 4 protruding forward, i.e. in the closing direction. The actuating bars 4 of the drop-down seals D2, D3 of the following panels T2, T3 protrude rearward, i.e. in an opposite direction to the closing direction. A laterally protruding arm 7 is arranged on said rearwardly protruding actuating bars 4, or said arm interacts therewith. The arm can be formed integrally with the actuating bar 4. However, the arm is preferably plugged onto the latter or fastened thereto in another manner.

The arm 7 extends toward the panel T3 following in each case in the closing direction or toward the rear frame A.

The panels T1, T2, T3 are of angular design at least in the lower region, i.e. in the region of said drop-down seals D1, D2, D3. The panels preferably have an L-shaped cross section, as illustrated in FIGS. 1 and 2.

In this example, the frontmost first panel T1, which is moved first during closing of the building opening, is designed differently than the other panels T2, T3. Its drop-down seal D1 is also not designed identically to the remaining drop-down seals D2, D3.

An automatic, mechanical drop-down seal of a known type is arranged in the first panel T1, said drop-down seal being actuated with pressure via triggering on one side when the panel T1 is present on the front frame R. This takes place because of the actuating bar 4 which protrudes beyond the housing of the seal and is connected to the lowering mechanism.

The remaining panels T2, T3 have an L-shaped cross section at least in the region of their seals. The protruding angle thus arising is arranged at the front end of the respective panels T2, T3. That is to say, said angle is at the front in the displacement direction of the corresponding panel T2, T3 during closing of the building opening. The rear frame A has an analogous angle in its front region in the closing direction.

These angles of the panels T1, T2, T3 and of the rear frame A serve as a stop surface for the arm 7 in order to activate the drop-down seal of the respectively preceding panel T2 during the closing operation. This can be readily seen in FIG. 2. The drop-down seal is therefore triggered by tension by the arm 7 being present at the angle B and therefore the actuating bar 4 being pulled even further out of the housing of the seal. As a result, the lowering mechanism of the seal is activated and the sealing strip is lowered. This is explained in more detail further below.

During opening of the building part, the arm 7 is released again from the angle B or the rear frame A and the tensile force on the actuating bar 4 is removed. As a result, the latter is pulled again further into the housing of the seal under spring loading and the lowering mechanism raises the sealing strip again. This can readily be seen in FIG. 1.

The angle of the second panel T2, which follows the first panel T1, can take on this function when the first panel T1 has the same drop-down seal as the other panels, i.e. is also triggered via tension. Since, however, in this example, the first drop-down seal D1 is triggered in a known manner via compression, the angle of the second panel T2 does not have the same function. However, said angle is preferably present at least for esthetic reasons so that the partition wall or the sliding door system has a uniform appearance.

The first panel T1 likewise has a protruding angle. However, the latter is arranged at the rear end of the panel T1, i.e. facing away from the front frame R. This angle also does not take on any function during the lowering of the seals, but is likewise present preferably for esthetic reasons.

The angles of the panels T1, T2, T3 in mutual interaction, like the arms, in combination with the adjacent angles preferably serve additionally as drivers and stops during the closing of the door.

However, this function may also be dispensed with depending on the configuration of the sliding mechanism of the building part.

If the drop-down seals are attached to the lower end side of the panels, the panels can also be formed without angles, wherein a corresponding angle, which serves as a driver for the arm of the adjacent seal, is formed on the exposed housing of the seal. Only the rear frame A is likewise intended to have a corresponding stop for the arm of the final seal.

A preferred embodiment of a drop-down seal of this type is illustrated in FIGS. 3 to 11. However, the concept according to the invention is not limited to such lowering mechanisms or sealing strips.

Figures 3, 4, 5, 6, 7:
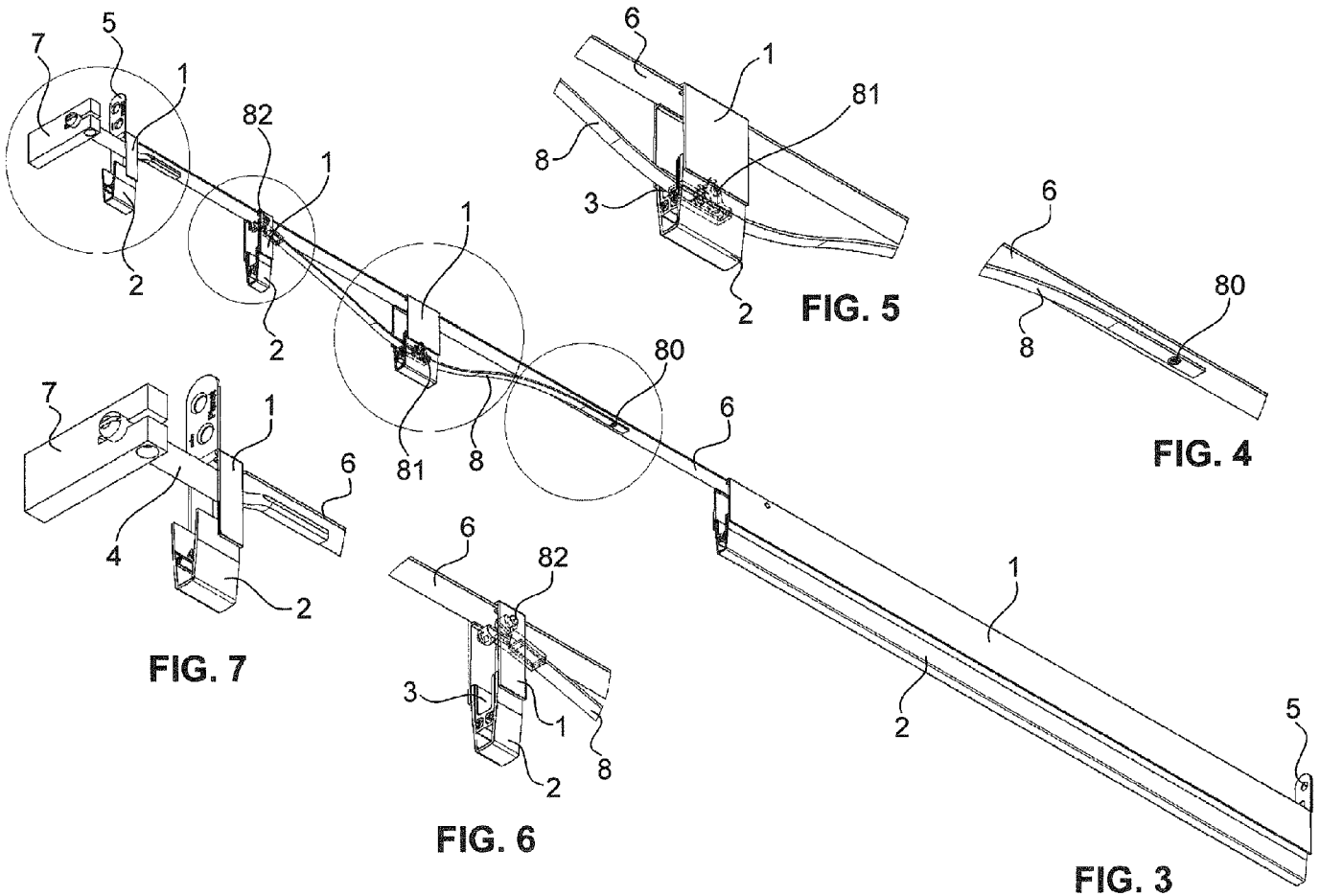
FIG. 3 shows a perspective illustration of a drop-down seal according to the invention, wherein details of individual parts are only illustrated in the left half.
FIG. 4 shows a perspective illustration of the drop-down seal according to FIG. 3 in the region of a first fastening point of a leafspring.
FIG. 5 shows a perspective illustration of the drop-down seal according to FIG. 3 in the region of a second fastening point of a leafspring.
FIG. 6 shows a perspective illustration of the drop-down seal according to FIG. 3 in the region of a third fastening point of a leafspring.
FIG. 7 shows a perspective illustration of the drop-down seal according to FIG. 3 in the region of a slide and arm protruding beyond a housing.

FIG. 3 shows a drop-down seal according to the invention with a housing 1 and a sealing strip 2, 3 which is raisable and lowerable relative to the housing. The housing 1 is a U-shaped profile rail of downwardly open design. The profile rail preferably consists of aluminum. It preferably extends over approximately the entire length of the panel and therefore of the seal. A part is not illustrated in FIG. 3 so that the interior of the seal can be seen better. The sealing strip 2, 3, which likewise extends over the entire length, is also only partially illustrated. The housing 1 is fastenable to the panel, for example, by means of angle brackets 5.

The sealing strip comprises a carrier profile rail 3 and a sealing element 2 arranged thereon. The carrier profile rail 3 is preferably likewise manufactured from aluminum. The sealing element 2 consists of an elastomeric material and, in the lowered state of the sealing strip, rests on the building floor in a sealing manner. The sealing strip is preferably manufactured from silicone, rubber or natural rubber. It can be of single-piece or multi-part design. It preferably has laterally sealing wings or limbs.

A lowering mechanism for lowering and raising the sealing strip 2, 3 is arranged in the housing 1. Said lowering mechanism is activated during closing of the building part such that it lowers the sealing strip. During opening of the building part, said lowering mechanism automatically raises the sealing strip again, preferably under spring loading. In this exemplary embodiment, the lowering mechanism has at least one, preferably two or more bending or leafsprings 8. If a plurality of leafsprings 8 are present, they are arranged spaced apart from one another one behind another in the longitudinal direction of the seal.

A force transmission rod 6 runs in the upper region of the U-shaped housing 1, i.e. adjacent to the upper web thereof. Said force transmission rod is preferably designed as a flat rod and is held in a corresponding groove in the housing 1. The force transmission rod 6 is displaceable relative to the housing 1 in the longitudinal direction thereof. The housing 1 has steps which preferably protrude on the inner sides of its parallel limbs and on which the rod 6 rests.

The at least one leafspring 8 is fastened in the seal at three locations. A first end of the leafspring 8 is fastened at a first fastening point to the force transmission bar 6. This fastening is rigid. This can readily be seen in FIG. 4. A middle region of the leafspring 8 is fastened to the sealing strip, more precisely to the carrier profile rail 3. This fastening is preferably positionally fixed, i.e. the leafsprings cannot be displaced in the longitudinal direction of the seal within the fastening point. This is illustrated in FIG. 5. At its second end, the leafspring 8 is fastened to the housing 1. This fastening is pivoting, i.e. the leafspring 8 can pivot relative to the housing 1. This can be readily seen in FIG. 6. Further leafsprings which may be present are fastened analogously.

An actuating bar 4 is arranged at a rear end of this force transmission rod 6. Rod 6 and bar 4 can be formed jointly as a single piece. However, the bar 4 is preferably fastened, for example welded, to the rod 6. The bar 4 is preferably designed as a threaded bar, and therefore its length can optionally be adjusted. This bar 4 protrudes beyond the housing 1 of the seal on one side. Owing to the thread, the excess length of the bar 4 can be adapted to the local conditions of the building and the seal can thus be optimally adjusted in situ.

An arm 7 is fastened to the protruding end of the fastening bar 4. Said arm can also be formed as a single piece with the bar 4. However, the arm is preferably plugged on, screwed on or fastened in another manner. The arm 7 protrudes at least approximately perpendicularly from the bar 4 and from the longitudinal direction of the seal. This can readily be seen in FIG. 7. The arm preferably also protrudes perpendicularly from the longitudinal surface of the seal and therefore from the panel surface. The arm 7 is preferably a substantially cuboidal block. It is preferably manufactured from plastic or a metal, in particular aluminum. The connection between arm 7 and bar 4 is preferably rigid and stiff, and therefore a force which acts on a side surface of the arm 7, which side surface faces the seal, can be transmitted to the actuating bar 4 and is transmitted by the actuating bar 4 bar as a tensile force to the force transmission bar 6, which is fixedly connected thereto.

Figure 9:
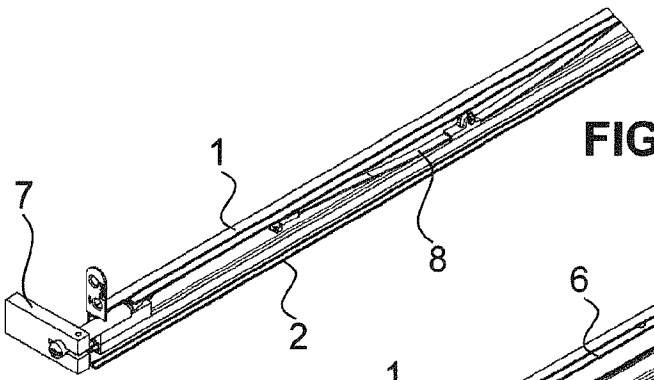
FIG. 9 shows a perspective sectioned illustration of the drop-down seal according to FIG. 8.
Figure 11:
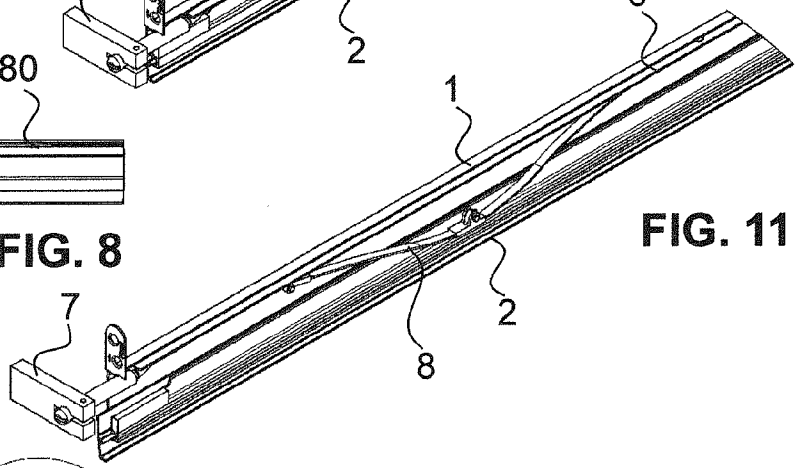
FIG. 11 shows a perspective sectioned illustration of the drop-down seal according to FIG. 10.
Figure 8:
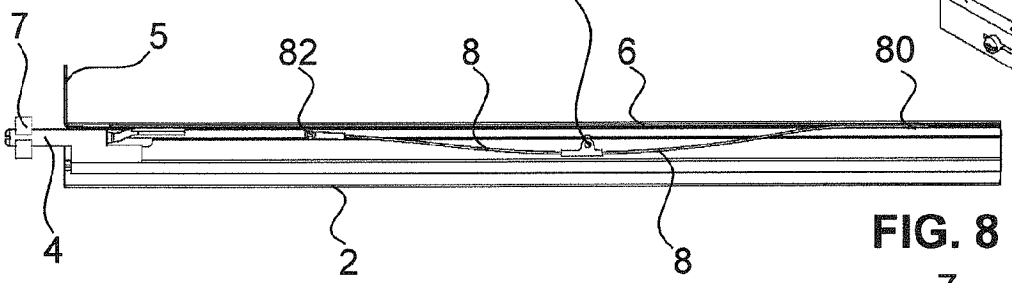
FIG. 8 shows a longitudinal section of a region of the drop-down seal according to FIG. 3 in the raised state of the sealing strip.
Figure 10:
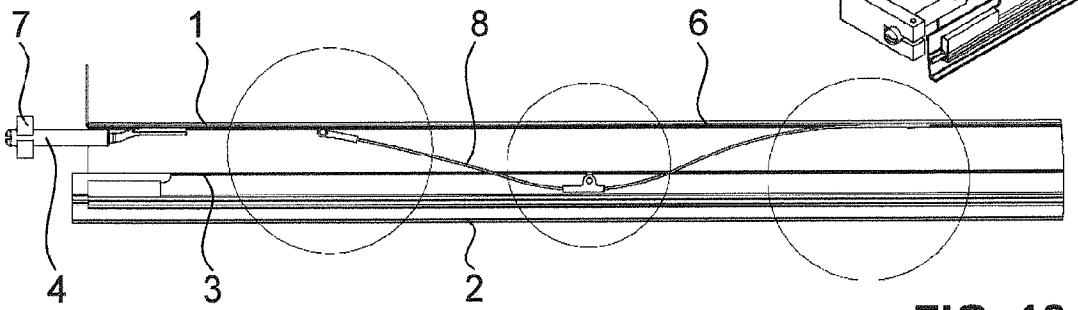
FIG. 10 shows a longitudinal section of a region of the drop-down seal according to FIG. 3 in the lowered state of the sealing strip.

FIGS. 8 and 9 illustrate the seal in the raised state. No force acts on the arm 7, and the actuating bar 4 protrudes only slightly beyond the housing 1. By contrast, in FIGS. 10 and 11, a force acts on the arm 7. As a result, the actuating bar 4 is pulled further out of the housing 1 and pulls the force transmission bar 6 with it. Owing to the three fastening points of the at least one leafspring 8, the latter is bent and lowers the sealing strip.

Figure 12:
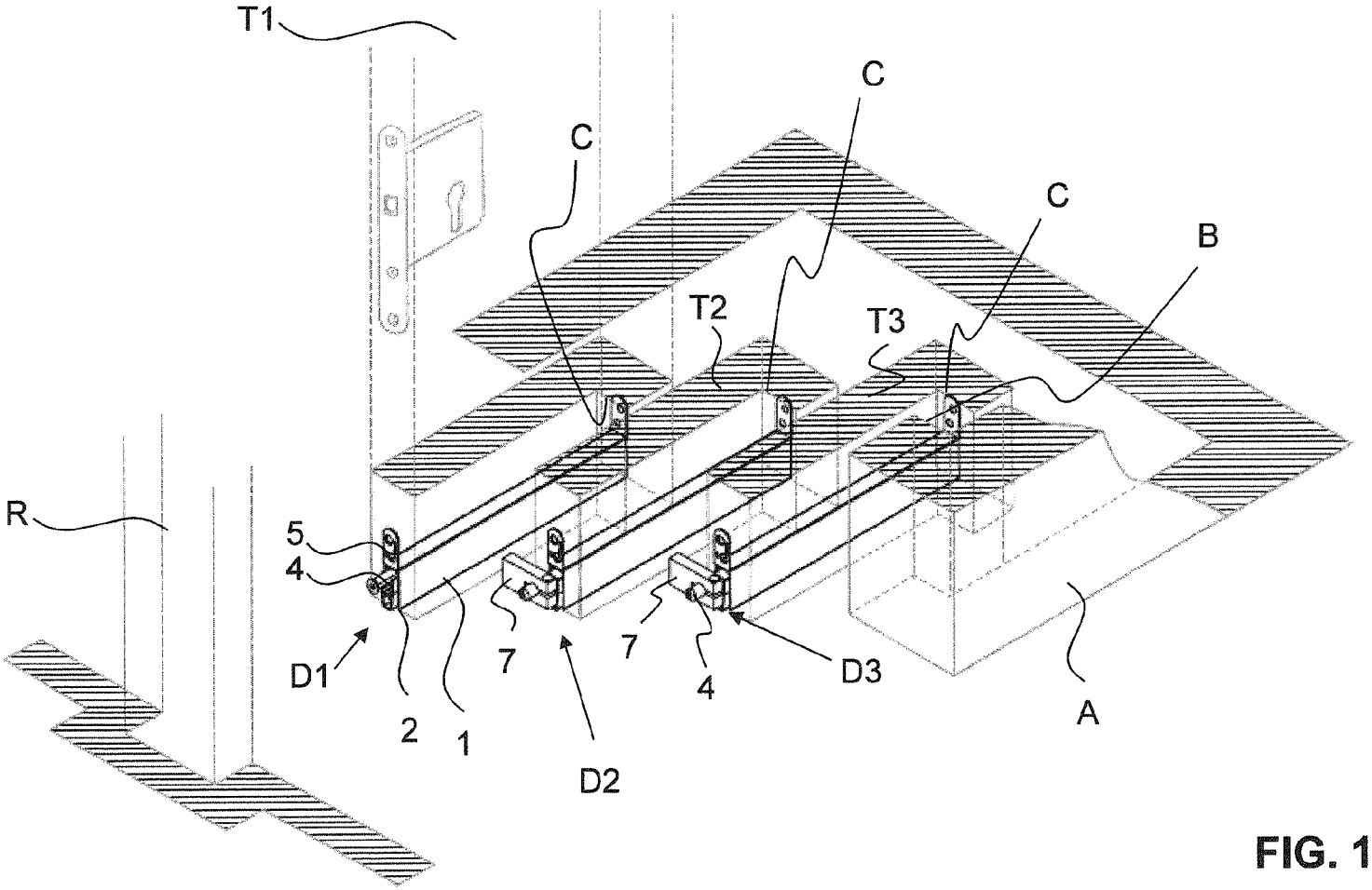
FIG. 12 shows a schematic illustration of a multi-part sliding door or partition wall or sliding door, in the partially open state with raised seals, in a second embodiment.

FIG. 12 illustrates a second exemplary embodiment according to the invention of a multi-part sliding door with a drop-down seal. The drop-down seal can correspond, but does not have to correspond, to that according to FIGS. 3 to 11.

In contrast to the exemplary embodiment according to FIGS. 1 and 2, the arm 7 here is arranged at that end of the actuating bar 4 which is at the front in the closing direction of the sliding door, or said arm acts on the front end of said actuating bar. The arm 7 here is directed in the opposite direction in comparison to the first exemplary embodiment. The panels T1, T2, T3 themselves are formed identically as in the first exemplary embodiment, i.e. they have an L-shaped cross section with a long limb forming the door leaf, and a short limb. The short limb is directed toward the panel T2, T3 which follows during the closing of the sliding door.

However, there are now the front stops C, i.e. those surfaces of the short limbs which are at the front in the closing direction, which stops, during closing of the sliding door, make contact with the rear surface of the arm and carry along the arm during the further closing. As a result, the actuating bar 4 which is connected or is operatively connected to the arm 7 is pulled out of the housing rail 1 and the seal is lowered.

It goes without saying that the lowering mechanism of the first seal D1 of the first panel T1, which panel precedes the other panels T2, T3 during the closing operation, is formed in a reflected manner with respect to the other seals D2, D3. That is to say, the first seal D1 is triggered by compression. If the actuating bar 4 of the first seal D1 is present on the front frame R, the actuating bar 4 is pressed in and the seal is lowered again.

The second embodiment according to FIG. 12 has the advantage over the first embodiment that, when the door is open or partially open, the arms 7 are freely accessible. This makes it easier to adjust the seal during installation and also facilitates a possible exchanging of individual parts, in particular the arms.

By contrast, the first embodiment according to FIGS. 1 and 2 has the advantage that the arms 7 are not visible either when the door is open or when the door is closed and that the appearance of the sliding door is therefore not impaired.

In both exemplary embodiments, all of the seal are raised during the opening of the sliding door as soon as the respective contact between respective stop surface B, C and arm 7 or between frame and actuating bar 4 is removed.

The drop-down seal according to the invention permits one-sided triggering by tension, with the seal being of space-saving design.

LIST OF DESIGNATIONS

1 Housing rail
2 Sealing element
3 Carrier profile rail
4 Actuating bar
5 Angle bracket
6 Force transmission rod
7 Arm
8 Leaf spring
80 First fastening point
81 Second fastening point
82 Third fastening point
D1 First drop-down seal
D2 Second drop-down seal
D3 Third drop-down seal
T1 First panel
T2 Second panel
T3 Third panel
R Front frame
A Rear frame
B Rear-side stop
C Front stop

The invention claimed is:

1. A drop-down seal for a building part, wherein the drop-down seal comprises:

a housing defining a longitudinal direction, a sealing strip which is raisable and lowerable in said housing, and a spring-loaded lowering mechanism which brings about automatic lowering of the sealing strip during closing of the building part, wherein the lowering mechanism is connected to a slide having an end which protrudes beyond the housing, the slide activating the lowering mechanism during closing of the building part, wherein the protruding end of the slide is operatively connected to an arm protruding laterally beyond the housing, wherein movement of the arm causes the slide to move to activate the lowering mechanism during closing of the building part, wherein the lowering mechanism comprises at least one spring configured to lower and raise the sealing strip, the at least one spring extending in the longitudinal direction of the housing and having a first end, a second end and a middle region, wherein the first end is rigidly connected to the slide defining a first fastening point, the middle region is connected to the sealing strip defining a second fastening point and the second end is fastened to the housing defining a third fastening point, wherein the second end is pivotable relative to the housing, wherein the first, second and third fastening points are spaced apart from each other in the longitudinal direction of the housing, wherein the third fastening point is arranged closer to the protruding end of the slide than the first fastening point, and wherein the arm pulls the slide when the building part is closed, the slide thereby applying a tension to the lowering mechanism.

2. The drop-down seal as claimed in claim 1, wherein the at least one spring is a leaf spring.

3. The drop-down seal as claimed in claim 1, wherein the slide has a force transmission rod extending in the housing and extending in the longitudinal direction of the housing.

4. The drop-down seal as claimed in claim 3, wherein the lowering mechanism is fastened at the first fastening point to the force transmission rod.

5. The drop-down seal as claimed in claim 1, wherein the arm is arranged on the slide, wherein the arm runs at least approximately perpendicular to a longitudinal direction of the sealing strip.

6. The drop-down seal as claimed in claim 5, wherein the arm runs at least approximately perpendicular to a lowering direction of the sealing strip.

7. The drop-down seal as claimed in claim 5, wherein the arm is fastened releasably to the slide.

8. The drop-down seal as claimed in claim 1, wherein the arm forms a stop surface for bearing against a stationary or movable neighboring part of the building part.

9. The building part with the drop-down seal according to claim 1, wherein the building part has at least one movable panel which closes a building opening, wherein the drop-down seal is attached to the movable panel, wherein the building part has a component which is adjacent to the movable panel and brings about the tension of the slide on the lowering mechanism.

10. The building part as claimed in claim 9, wherein the adjacent component has a stop surface for the arm, said stop surface running at least approximately perpendicular to a longitudinal direction of the sealing strip.

11. The building part as claimed in claim 10, wherein the adjacent component is a second movable panel.

12. The building part as claimed in claim 9, wherein the building part is a sliding door, a multi-part sliding door system, a sliding window, a multi-part sliding window system or a single-part or multi-part partition wall.

* * * * *